United States Patent [19]

Grace

[11] 4,305,032

[45] Dec. 8, 1981

[54] BROAD BAND SATURABLE REACTOR REGULATED POWER SUPPLY

[76] Inventor: Alan G. V. Grace, 11 Bay View Dr., San Carlos, Calif. 94070

[21] Appl. No.: 47,813

[22] Filed: Jun. 12, 1979

[51] Int. Cl.[3] ..... G05F 1/32

[52] U.S. Cl. ..... 323/249; 323/254; 363/91

[58] Field of Search ..... 323/56, 249, 254; 363/91

[56] References Cited

U.S. PATENT DOCUMENTS

| | | | |
|---|---|---|---|
| 2,751,545 | 6/1956 | Chase | 363/91 |
| 2,814,014 | 11/1957 | Hayes | 363/91 |
| 2,943,697 | 5/1960 | Little | 363/91 |
| 3,113,257 | 12/1963 | Hase | 363/91 |
| 3,122,694 | 2/1964 | Muchnick et al. | 363/91 |
| 3,246,170 | 4/1966 | Olshan | 363/91 X |
| 3,452,268 | 6/1969 | Grossoehme | 363/91 |

*Primary Examiner*—William M. Shoop

*Attorney, Agent, or Firm*—Allan R. Fowler

[57] ABSTRACT

A saturable reactor regulated power supply utilizes a power oscillator to convert line voltage to a higher frequency voltage. The high frequency voltage is passed through the gate windings of a saturable reactor to an output circuit including an output power transformer. A feedback circuit interconnected between the output circuit and control windings of the saturable reactor controls the control winding current in order to pulse modulate the voltage applied to the output circuit. The feedback circuit includes several resistors which are connected to cause a phantom control winding resistance $R_c^*$ which is much greater than that of a control winding series resistor $R_1$. The created phantom resistance $R_c^*$ causes the control winding circuit time constant to be substantially less than that which would otherwise be provided by the series resistor $R_1$; whereas, the resistor $R_1$ determines the control winding power loss.

3 Claims, 4 Drawing Figures

BROAD BAND SATURABLE REACTOR REGULATED POWER SUPPLY

The present invention relates to electrical power supplies and more particularly to power supplies regulated by a saturable reactor, or magnetic amplifier.

Many types of electric and electronic equipment require closely regulated, stable power supplies. Such power supplies are capable of providing a constant output voltage to the equipment, or load, despite line voltage transients and variable current or power demands by the load.

Examples of equipment needing closely regulated power supplies are travelling wave tubes, radar systems and some electric motor driven servo systems. In some equipment the power demand is for various different voltages, each requiring close regulation, in other equipment the need is for a variable output voltage.

While a conventional linear power supply may be utilized to power such equipment, a power supply utilizing a saturable reactor, or magnetic amplifier, for regulation purposes, may be more efficient, economical and lighter in weight.

A saturable reactor regulated power supply typically utilizes a power oscillator to convert incoming line voltage to a higher frequency voltage and an output power transformer for converting the high frequency voltage to a desired output voltage, the latter being passed through a rectifier and filter circuit if a D.C. output is desired. The output of such a power supply may be regulated by modulating the high frequency voltage from the power oscillator before it enters the power transformer. This modulation is accomplished with the use of a saturable reactor, or a magnetic amplifier, having a pair of gate windings connected in series with each other and the power oscillator and high voltage transformer.

Regulation of the power supply output is commonly done by use of a feedback circuit which varies current through control windings of the saturable reactor in order to pulse modulate the voltage applied to the output power transformer. The saturable reactor functions as a switch with the gate windings presenting little resistance between the power oscillator and the output power transformer when the saturable reactor is firing, and presenting a high resistance therebetween when the saturable reactor is not firing, the time of firing being regulated by the current in the control winding.

As hereinabove mentioned, this type of power supply design has the advantage of using both lighter and lesser expensive components than, for example, a conventional linear power supply, and further, it has a relatively high transform efficiency.

However, such power supplies may be subject to instability, with regard to output voltage, because of line voltage transients and/or variable load demands. The response time of such power supplies is typicaly about 0.5 milliseconds, corresponding to a first break w of 2 Krads. or, in terms of bandwidth, about 2 KHz.

It should be appreciated that in order for a power supply to adequately regulate, or hold output voltage constant, the power supply bandwidth must be substantially greater than the rate of change, or bandwidth, of both line voltage transients and load demand variations.

Hence, a conventional saturable reactor regulated power supply may not have sufficient bandwidth, when connected to a 400 Hz supply line, to accommodate line voltage transients of approximately 800 Hz (twice the nominal line frequency). That is, such line voltage transients may cause variations in the power supply output voltage.

Similarly, when such a conventional power supply is used as a driver for an electric motor in a high frequency servo system, wherein the varying current demands by the motor may correspond to a bandwidth as high as 2 KHz, the power supply output voltage may not be sufficiently regulated.

Conventional saturable reactor regulated power supplies typically have fixed voltage outputs which can not be varied over a range exceeding a maximum voltage to minimum voltage ratio of approximately 1 and a half. Hence, a separate power supply must be designed and configured for each load voltage requirement.

The present invention provides a saturable reactor regulated power supply which has a variable output over a wide range, for example, a maximum voltage to minimum voltage ratio of up to 5, while at the same time having a bandwidth of over 5 KHz. Further, the present invention provides a power supply having a number of separately regulated output voltages from a single line source.

Such performance is enabled by a saturable reactor control winding feedback circuit configuration which synthesizes a series control winding resistance $R_c^*$. This synthesized, or phantom, resistance is an apparent resistance in the control winding circuit having a very high value, thus enabling rapid response of the saturable reactor and a power supply having a large bandwidth as will be hereinafter discussed.

For a regulated power supply adapted for being connected to a constant line voltage and for providing a preselected regulated voltage to a load having a variable power demand and including a power oscillator circuit which converts the line voltage to a higher frequency voltage; an output circuit adapted for connecting to the load and providing the regulated output voltage thereto; a saturable reactor operative for modulating the higher frequency voltage from the power oscillator circuit, the reactor having a gate winding interconnected between the power oscillator and the output circuit and also having a gate winding, a feedback control circuit, in accordance with the present invention, for controlling control winding current in response to varying power demand of the load. Such circuit comprises load current sensing means enabling the voltage modulation by the saturable reactor in response to load current fluctuations, to thereby maintain the preselected regulated voltage to the load, the sensing means including a low resistance value resistor, $R_1$, connected in a control winding circuit in series with the control winding.

Further comprising the feed back circuit are resistor means providing a phantom, control winding series resistance, $R_c^*$, which is at least several times greater than that of the current sensing resistor $R_1$. Accordingly, the phantom resistance, $R_c^*$, causes a time constant, $t_c$, of the control winding circuit to be much shorter, and hence response time thereof to be much faster, than would otherwise be provided only by the resistor $R_1$. However, undesirable power dissipation in the control winding circuit is determined by the small current sensing resistor $R_1$ and not by the larger phantom resistance $R_c^*$.

The resistor means includes resistors $R_2$ and $R_3$ which are connected to effect a preselected voltage feed back ratio causing a power ratio, $A_v$, which is equal to $(R_1+R_2+R_3)\div(R_1+R_2)$, $R_c^*$ being equal to $R_1(Av-1)$ and the time constant, $t_c$, being equal to control winding inductance, $L_c$, divided by control winding circuit resistance $R_c$ which is substantially equal to the phantom resistance, $R_c^*$.

$R_1$ may be selected to be 1.5 ohms and $R_2$ and $R_3$ may be additionally selected to cause $R_c^*$ to be about 36 ohms, that is, about 24 times $R_1$.

As a result of $R_c^*$ being much greater than $R_1$, to which $R_c$ would otherwise be approximately equal, the circuit time constant, $t_c$, is much shorter (for example, only 1/24th as long) than it would be if only $R_1$ were to be considered.

On the other hand, only the resistor, $R_1$, contributes to the control winding power dissipation, which is therefore much less, for example, only 1/24th as great) as it would be if the phantom resistance $R_c^*$ acted to dissipate power.

Thus, the phantom resistance, $R_c^*$, appears to be present for determining the time constant, $t_c$, but is not present for determining undesirable power dissipation.

A plurality of similar, separate channels enabling different preselected regulated voltages for a plurality of loads may be connected to a common power oscillator circuit which provides high frequency voltage to a plurality of output channels. Each channel may be provided with a feedback circuit of the described configuration.

These features provide a number of advantages, for example, a saturable reactor regulated power supply having a broad bandwidth, or rapid response time, while additionally being more efficient because less power is dissipated in the control winding circuit of the reactor. Further, voltage regulation can be provided for each of separate output channels.

The foregoing and other features and advantages will be apparent from the following specification describing an exemplary embodiment of the invention, taken in conjunction with the accompanying drawings, in which.

Figure 1:
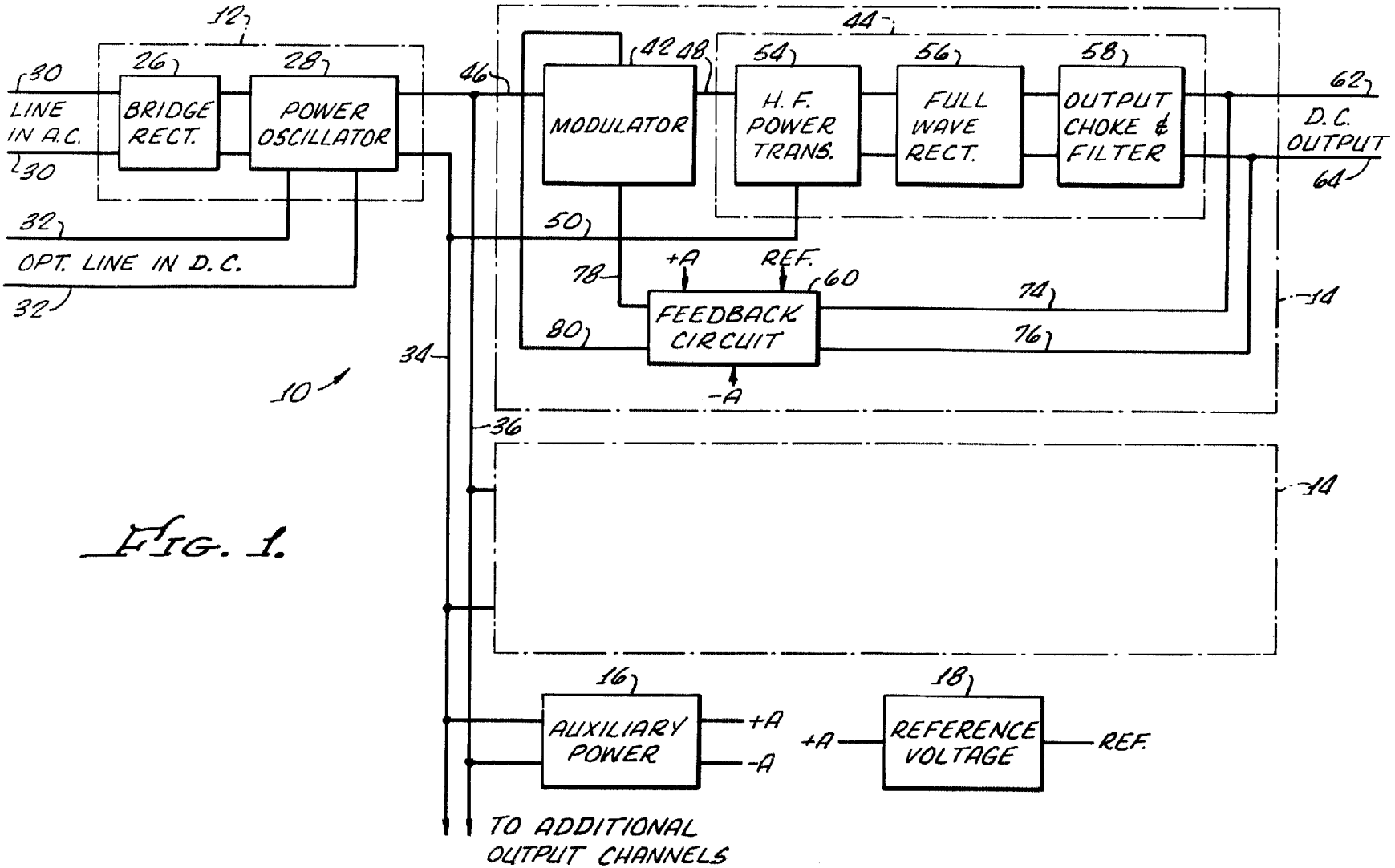
FIG. 1 is a block diagram of a power supply in accordance with the present invention showing generally a power oscillator circuit and two exemplary voltage output channels, each including a modulator, output circuitry and a feedback circuit.

Referring now to the drawings, FIG. 1 shows, in block diagram form, a power supply 10, in accordance with the present invention, which generally includes a power oscillator circuit 12, a plurality of output channels 14, an auxiliary power circuit 16 and a reference voltage circuit 18. It is to be appreciated that since each of the output channels 14 are identical, only one of the channels is detailed for clarity of presentation.

The power oscillator circuit 12 may include a conventional bridge rectifier circuit 26 for providing D.C. input to a power oscillator 28 from an A.C. line voltage source 30, or the power oscillator may be supplied direct current from an alternate D.C. line voltage source 32.

By switching the inputted D.C. voltage, the power oscillator, which may be of conventional design, operates to generate a higher frequency voltage to a pair of bus lines 34, 36. This high frequency voltage may have, for example, a peak to peak value of 56 volts and a frequency of approximately 20 KHz.

Each output power channel 14 is connected to the bus 34, 36 along with the auxiliary power circuit 16 which includes a conventional transformer rectifier and filter circuit, not shown, for providing appropriate bias voltages +A, −A, and power as needed to each output channel. Additionally, the auxiliary power circuit provides +A voltage to a conventional reference voltage circuit which in turn provides an appropriate reference voltage, REF, to the output channels 14.

The output channel 14 includes a modulator 42 interconnected between power oscillator circuit 12 and an output means or circuit 44 via the bus line 36, channel input line 46, and line 48. A second line 50 connects the output circuit 44 to the bus line 34. Being of usual design, the output circuit may include a high frequency power transformer 54 for stepping the power oscillator voltage to a desired channel output voltage level, and providing isolation between the output circuit and other portions of the power supply 10. A full wave rectifier 56 and an output choke and filter circuit 58 may be provided if the desired channel output is D.C. voltage.

Alternatively, and in accordance with well known design principles, the output circuit may not include the high frequency power transformer, or the full wave rectifier 56 and choke and filter circuit 58 depending upon the desired output voltage and type, i.e., A.C. or D.C.

Figure 2:
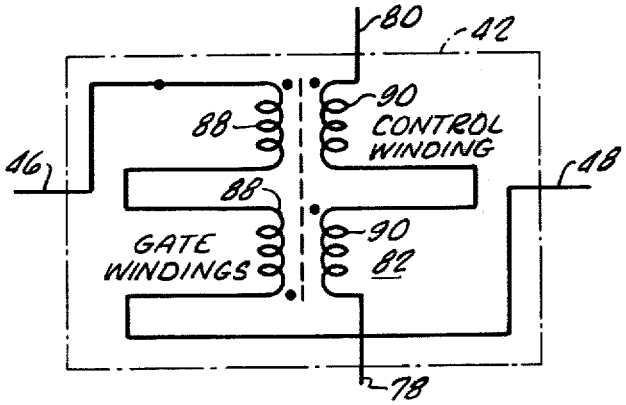
FIG. 2 is a schematic representation of a saturable reactor for use as the modulator shown in FIG. 1.

A feedback circuit 60 is interconnected between channel output lines 62, 64 and the modulator 42 via lines 74, 76 and 78, 80 respectively. The modulator may be a conventional type saturable reactor, or magnetic amplifier 82 as represented in FIG. 2, having gate windings 88 interconnected between the power oscillator circuit 12 and the output circuit 44 via lines 46 and 48 respectively, and control windings 90 interconnected with the feedback circuit 60 via lines 78, 80 respectively.

As hereinbelow discussed, the saturable reactor 82 operates as a switch to modulate the high frequency voltage from the power oscillator circuit 12 to the output circuit 44.

Figure 3:
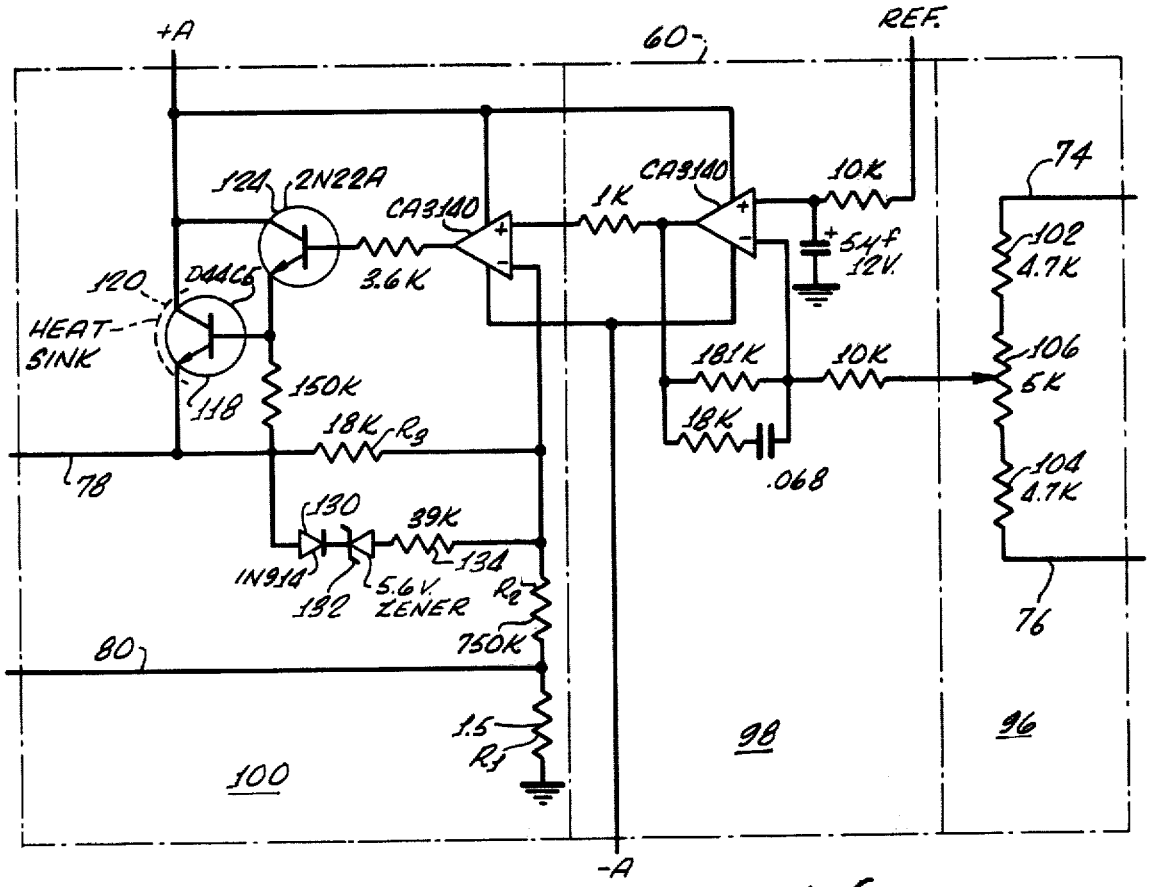
FIG. 3 is a schematic circuit diagram of the feedback circuit shown in FIG. 1; and, FIG. 4 is a representation of a motor load with an associated series resistor which may be driven and controlled by the power supply shown in FIG. 1.

Turning now to FIG. 3, the feedback circuit 60 generally includes a sensing means or circuit 96, an amplifier circuit 98 and a reactor control winding and impedance, or driver circuit 100. It is to be appreciated that the resistor and capacitor values and component identification numbers are typical values, and that any component substitution which may occur to those skilled in the art, should be considered to be within the scope of the present invention. The sensing circuit includes a pair of resistors 102, 104 and a potentiometer 106, connected to the output lines 62, 64 via lines 74, 76 respectively, the output current being determined by the voltage drop across the sensing circuit 96.

Figure 4:
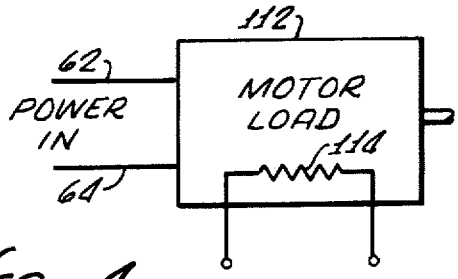

Alternatively, if the power supply is used to drive a motor 112, FIG. 4, the sensing circuit may be connected across a resistor 114 appropriately connected with the motor windings, not shown, in order to determine the current therein, and enable the power supply to regulate motor torque.

Referring again to FIG. 3, the amplifier circuit 98 may be of typical design for providing an amplified signal, generated by the sensing circuit 96, to the driver 100.

The driver circuit 100 operates in response to varying power demands from a load, not shown in FIG. 3, as determined by the sensing means, to control the current through the reactor control winding 90 provided by the auxiliary power circuit 16 through +A and lines 78, 80.

In accordance with well known design principles the saturable reactor, FIG. 2, configuration is dependent upon the desired power output of the power supply. For example, for an output of 15 volts and 2 amps D.C. into a load, not shown, the gate winding 88($N_g$), may be approximately 45 turns of 25 gauge wire, and the control winding, 90($N_c$), may be 270 turns of 30 gauge wire, giving a ratio of $N_c/N_g$ equal to approximately 6. The ratio corresponds to the gain of the saturable reactor.

As described in Magnetic Amplifiers by H. F. Storm, published by John Wiley, New York, 1955, the gate voltage change necessary to accommodate transient load demand is in part limited by the time constant $T_c$ of the control winding circuit, and $$T_c = \frac{L_c}{R_c}, \tag{1}$$

where $L_c$ is the effective inductance of the control winding, and $R_c$ is the resistance of the control winding and resistance in series therewith in the driver circuit 100.

The effective inductance $L_c$ is:

$$L_c = \frac{R_o}{4f}\left(\frac{N_c}{N_g}\right)^2 \tag{2}$$

where f is the frequency of operation and $R_o$ is the output resistance of the saturable reactor.

Hence, it is apparent that it is desirable to have the driver circuit 100 include a series resistance in order to reduce the time constant of the reactor 82, see equation (1), and hence, the power supply 10.

However, inasmuch as such a series resistance must carry considerable current in order to saturate the reactor, it dissipates considerable power and as a result lowers the efficiency of the power supply. For example, for the power supply 10, with the output channel providing an output of 15 volts at 2 amps, the current in the control winding may be up to ¼ amperes.

Turning again to FIG. 3, the driver circuit 100 connects the reactor control winding 90 to the power source +A via line 78 through a transistor 118, which may be mounted on a heat sink, represented by the dashed line 120. Line 80 connects the control winding 90 to −A through a low resistance $R_1$ value to complete a circuit through the control winding.

The driver circuit 100 configuration utilizes the transistor 118, an amplifying transistor 124 and resistors $R_1$, $R_2$ and $R_3$ to provide a synthesized, or phantom resistance $R_c^*$ in series with the control winding 90 equal to:

$$R_c^* = R_1 (A_v - 1), \text{ where} \tag{3}$$

$$A_v = \frac{R_3 + R_2 + R_1}{R_1 + R_2} \tag{4}$$

For the resistance values shown in FIG. 3, the synthesized resistance $R_c^*$ is 36 ohms.

Using the formula $T_c = Lc/R_c$, $T_c$, for $R_c = 36$ ohms, is approximately 0.2 milliseconds, which corresponds to a power supply first break w of approximately 5.3 Krads.

The driver circuit 100 causes the saturable reactor to perform as if it had a resistance of 36 ohms in series with the control windings 90, without having any substantial fixed resistance in series therewith. The only other voltage drop in the control winding circuit between +A and −A is the drop across resistor $R_1$, and across the transistor 118.

The low value (1.5 ohms) of the resistor $R_1$ does not cause significant voltage drop thereacross, and does not signficantly reduce the efficiency of the power supply 10.

For comparison, a conventional saturable reactor modulator power supply, not shown, typically utilizes a 15 ohm fixed resistor in series with the reactor control winding, and a driving transistor. Hence, the bandwidth of such a conventional power supply utilizing the saturable reaction 82 would be only, in accordance with equation (1) approximately 2 Krad. In addition to a much lower bandwidth, the conventional power supply is less efficient because of the power dissipated across the fixed series resistance of 15 ohms.

When the saturable reactor is firing and current is established in the control winding, the emitter voltage of the driving transistor 120 is low. However, when the saturable reactor stops firing the voltage at the emitter of transistor 120 begins to rise. To limit the peak of this voltage excursion, a diode 130, 5.6 V zener diode 132 and resistor 134 are connected in parallel with R3. Hence, when the voltage at the emitter reaches approximately 5.6 V, the low resistor 134 clamps the high resistor R3 to reduce the emitter voltage.

It is well known that the stability of a saturable reactor power supply is related to the power supply bandwidth, the higher the bandwidth, the greater the stability.

The bandwidth, and hence stability, of the power supply is determined by the saturable reactor and control winding driver circuit as hereinabove discussed. A more stable reactor is operable for a greater range of modulation, without unwanted oscillation, than a less stable reactor. It follows that with a greater range of modulation, a power supply output voltage can be more widely varied.

It is to be appreciated that, the driver circuit 100 configuration is synthesizing a 36 ohm resistance in series the control winding, enables the saturable reactor, and the power supply, to have sufficient stability over a wider range than a conventional type saturable reactor power supply utilizing a large fixed series resistor.

Turning to the the sensing circuit 96, it is apparent that to potentiometer 106 provides a means for enabling selection of the output voltage, by varying the voltage thereacross which in turn, through the amplifier circuit 98 and the driver circuit 100, adjusts the amount of current in the control winding.

This in turn adjusts the amount of modulation of the high frequency voltage from the power oscillator 12 circuit to the output circuit 44, resulting in a higher or lower output voltage.

Although there has been described hereinabove a particular arrangement of fire control apparatus for the purpose of illustrating the manner in which the invention may be used to advantage, it will e appreciated that the invention is not limited thereto. Accordingly, any and all modifications, variations or equivalent arrangements which may occur to those skilled in the art, should be considered to be within the scope of the invention as defined in the appended claims.

What is claimed is:

1. In a regulated power supply adapted for being connected to a constant line voltage and for providing a preselected, regulated voltage to a load having a variable power demand, and including a power oscillator circuit which converts the line voltage to a higher frequency voltage, an output circuit adapted for connecting to the load and providing the regulated output voltage thereto; a saturable reactor operative for modulating the higher frequency voltage from the power oscillator circuit, the reactor having a gate winding interconnected between the power oscillator and the output circuit and also having a control winding, a feedback control circuit connected between the output circuit and the saturable reactor control winding for controlling control winding current, in response to varying power demands of the load connected to the output circuit, said feedback control circuit comprising:

(a) load current sensing means enabling said voltage modulation by the saturable reactor in response to load current fluctuations to thereby maintain said preselected regulated voltage to the load, said sensing means including a low resistance current sensing resistor, $R_1$, connected in a control winding current in series with the said control winding; and (b) resistor means providing a phantom, control winding series resistance, $R_c^*$, which is at least several times greater than that of the current sensing resistor $R_1$, said phantom resistance $R_c^*$ causing a time constant, $t_c$, of the control winding circuit to be much shorter, and hence response time of the saturable reactor to be much faster, than that which would otherwise be provided by only the resistor $R_1$, undesirable power dissipation in the control winding circuit being, however, determined by $R_1$ but not by $R_c^*$.

2. The feedback control circuit according to claim 1, wherein the resistor means includes resistors $R_2$ and $R_3$ connected to effect a preselected voltage feedback ratio causing a power ratio, Av, which is equal to $$\frac{R_1 + R_2 + R_3}{R_1 + R_2},$$

wherein $R_c^*$ is equal to $R_1$ (Av−1), and wherein $t_c$ is equal to control winding inductance, $L_c$, divided by control winding circuit resistance, $R_c$, which is substantially equal to the phantom resistance $R_c$.

3. The feedback control circuit according to claim 2, wherein $R_1$ is selected to be approximately 1.5 ohms and where $R_2$ and $R_3$ are additionally selected to cause $R_c^*$ to be approximately 36 ohms, $R_c^*$ being thereby equal to approximately 24 $R_1$.

* * * * *